US005113782A

United States Patent [19]

McCarty

[11] Patent Number: 5,113,782

[45] Date of Patent: May 19, 1992

[54] BOAT BOARDING LADDER

[76] Inventor: Robert T. McCarty, 227½ Huron Ave., Port Huron, Mich. 48060

[21] Appl. No.: 638,058

[22] Filed: Jan. 7, 1991

[51] Int. Cl.[5] ..... B63B 29/20

[52] U.S. Cl. ..... 114/362; 114/364; 182/93; 182/206

[58] Field of Search ..... 114/343, 362, 364; 182/87, 91, 97, 86, 93, 150, 151, 206, 228

[56] References Cited

U.S. PATENT DOCUMENTS

| | | | |
|---|---|---|---|
| 4,062,299 | 12/1977 | Smith | 114/364 |
| 4,153,137 | 5/1979 | Johnson | 114/362 |
| 4,719,989 | 1/1988 | Ritten | 114/362 |
| 4,724,925 | 2/1988 | Ritten | 114/362 |

FOREIGN PATENT DOCUMENTS

| | | | |
|---|---|---|---|
| 743995 | 1/1956 | United Kingdom | 114/362 |

*Primary Examiner*—Jesus D. Sotelo
*Assistant Examiner*—Stephen P. Avila
*Attorney, Agent, or Firm*—Brooks & Kushman

[57] ABSTRACT

A boat boarding ladder telescopically mounts to fishing rod holders fixedly secured within gunnels on either side of a boat. The ladder is of an inverted J-shaped configuration and is comprised of an ascending connector portion, a transverse bridging portion and a descending ladder portion. The ladder portion has laterally spaced standoff legs to bear against the hull of the boat and longitudinally spaced steps. The transverse portion bridges the gunnel and rest thereupon. The connector portion comprises a connector tube which extends generally downwardly and is pivotally connected to the transverse portion such that the axis of the connector tube sweeps out a conical path. The axes of the rod holders are generally orientated relative to the gunnels such that fishing rods held therewithin extend rearwardly and laterally outwardly. Thus, the axis of the connector tube may be coaxially alignable with the axes of the rod holder, allowing for telescopic engagement of the connector tube to the rod holders while the ladder portion remains generally vertical along the hull of the boat. When the ladder is transferred from one side of the boat to the other, the connector tube is pivotably adaptable to coaxially align with a rod holder on such other side, allowing for telescopic mounting of the ladder thereto while the ladder portion remains vertical.

6 Claims, 1 Drawing Sheet

BOAT BOARDING LADDER

TECHNICAL FIELD

This invention relates to a boat boarding ladder and more particularly, to a ladder which releasably secures to a rod holder fixedly secured within the gunnel of a boat.

BACKGROUND ART

The prior art discloses boat boarding ladders that generally fall into one of two categories. In the first are ladders that simply hook over the edge or gunnel of a boat for support. U.S. Pat. Nos. 2,758,770, 2,924,291 3,078,955, 3,858,683 and 4,002,223 disclose ladders utilizing this type of attachment. These ladders are often unstable and may slide longitudinally along the edge or gunnel of the boat.

The second category includes ladders which affix to brackets which are permanently secured to a boat. Examples of these ladders are disclosed in U.S. Pat. Nos. 4,637,492 and 4,719,872, which have brackets permanently secured to the back surfaces of boats, U.S. Pat. No. 3,512,609 which has a bracket permanently secured to the top edge of the side of a boat, and U.S. Pat. No. 4,719,989 which has a bracket permanently secured to either a stern platform or the topside of a boat. A particular disadvantage that these boat boarding ladders have is that special brackets or mounts must be installed in order to make the ladders securable to a boat. These brackets or mounts serve the sole purpose of securing the ladder.

Often boats are manufactured with fishing rod holders installed in their gunnels. It is also possible to install these rod holders into gunnels at a later date. The axes of the rod holders are typically orientated such that when a fishing rod is inserted in the rod holders, the fishing rod will extend laterally outwardly and rearwardly from the gunnel. This allows fishing line trailing from the fishing rod to stay clear of the boat when trolling. Consequently, the rod holders must extend downwardly into the gunnels in a forwardly and laterally inward direction to give the desired angular orientation to a fishing rod mounted therein.

The present invention provides a boat mounting ladder that is mountable to either the starboard or the port side of a boat and takes advantage of the preexisting rod holders on a boat.

DISCLOSURE OF THE INVENTION

An object of the present invention is to provide a boat boarding ladder which telescopically mounts to a rod holder contained within the gunnel of a boat.

Another object is to provide a ladder which mounts over the gunnel of a boat but cannot slide longitudinally thereon.

Yet another object of the present invention is to provide a ladder having an ascending connector portion, a transverse portion, and a descending portion wherein the connector portion includes a single connector tube being non-coaxially and rotatably secured to the transverse portion, wherein the ladder is telescopically mountable and adaptably received by rod holders fixedly secured within gunnels on either side of a boat.

The present invention discloses a boat boarding ladder which is telescopically mountable to rod holders fixedly secured within gunnels on either side of a boat.

The ladder comprises an ascending connector portion, a transverse portion, and a descending portion. The descending portion has a descending rail along which are fixedly secured longitudinally spaced steps and laterally spaced standoff legs, the standoff legs are abuttable against a side of the boat. The transverse portion has a transverse rail, with a pad secured therebeneath, which extends transversely across the top of the gunnel with the pad abutting the top thereof. The upper end of the vertical portion connects to the laterally outer end of the transverse portion.

The connector portion includes a connector tube having a connector end and a telescopic end. The connector portion connects adjacent the connector end to the terminal end of the transverse portion and extends generally downwardly therefrom.

The connector tube is pivotable about the terminal end of the transverse portion such that its axis is coaxially alignable with non-vertical axes of rod holders, the rod holders being located on either the port side or the starboard side of the boat. This allows the connector tube to be telescopically received within the rod holders, while the descending portion remains in a generally vertical orientation. The descending portion and the transverse portion are sufficiently flexible to allow the standoff legs to abut the side of the boat when a person's weight is placed upon the steps of the ladder.

BEST MODE FOR CARRYING OUT THE INVENTION

Figure 1:
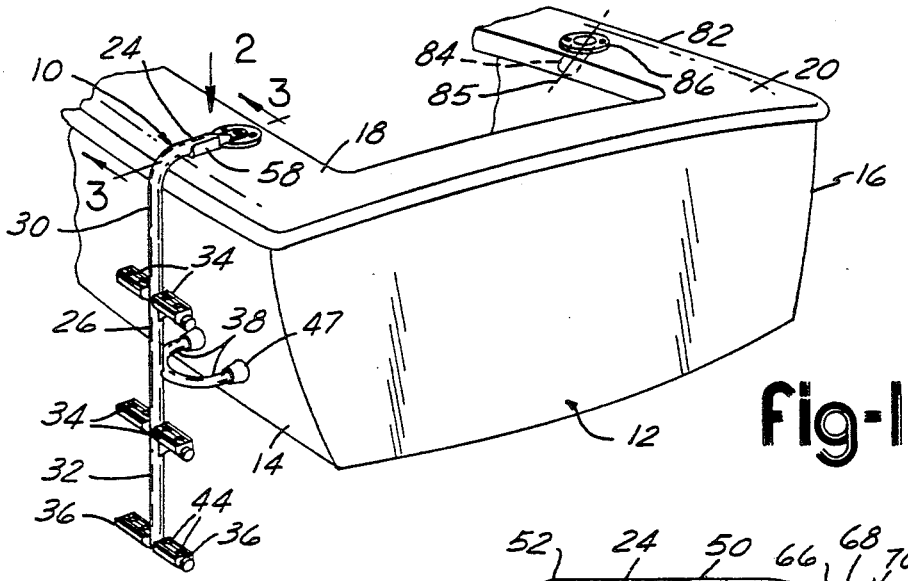
FIG. 1 is a perspective view of the ladder of the present invention mounting on the port side of a boat.
Figure 2:
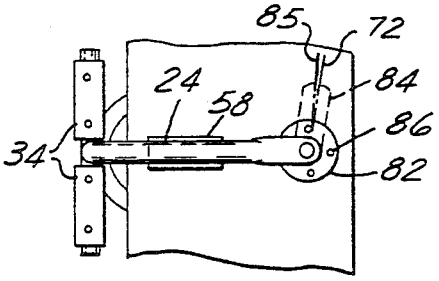
FIG. 2 is a partial top view in the direction of arrow 2 in FIG. 1 of the ladder mounting to the boat.

FIG. 1 shows a boat boarding ladder 10 mounting to the port side 14 of gunnel 18 of a boat 12. Laterally opposite the port side 14 are gunnel 20 and starboard side 16. Ladder 10 in the preferred embodiment is of an inverted J-shaped configuration and comprises an ascending connector portion 22, a transverse portion 24 and a descending portion 26.

Descending portion 26 comprises a round tubular descending rail 32, which has a lower end 28 and upper end 30, and longitudinally spaced intermediate steps 34 and bottom steps 36 and laterally spaced, with respect to the side 14 of the boat 12, standoff legs 38.

Intermediate steps 34 and bottom steps 36 include step tubes 40, which are fixedly attached at one end to rail 32, covers 42 mounted atop each step tube 40 via fasteners 44 and end caps 45 which are adhesively affixed to and fluidly seal the free ends of step tubes 40. Intermediate steps 34 and bottom steps 36, respectively, are paired at discrete longitudinal positions such that one step extends laterally forwardly and another step extends laterally rearwardly. Bottom steps 36 are located adjacent lower end 28 of rail 32 with intermediate steps 34 spaced longitudinally thereabove.

Covers 42 and end caps 45 are made of a soft, non-scuff material such as rubber. Triangular shaped gusset plates 46 fixedly secure to rail 32 and to the lower surfaces to step tubes 40 of intermediate steps 34 thereby providing vertical support.

Standoff legs 38 each fixedly secure at one end to rail 32 intermediately between lower end 28 and upper end 30 with one leg extending laterally forwardly and then inwardly and one leg extending laterally rearwardly and then inwardly. The free ends of standoff legs 38 are adhesively affixed to and fluidly sealed by feet 47 which are also made of a soft, non-scuff material.

Figure 3:
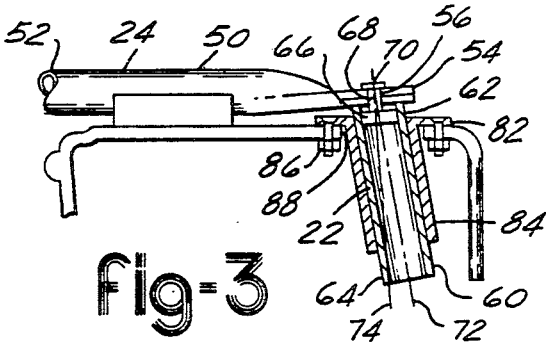
FIG. 3 is a partial sectional side view taken along line 3—3 of FIG. 1 showing the connector tube telescopically mounting within a rod holder.

Transverse portion 24, as best seen in FIG. 3, comprises a round tubular transverse rail 50, which has an outer end 52 and a terminal end 54 which is flattened and contains aperture 56. A pad 58 made of a soft, non-scuff material is adhesively secured beneath transverse rail 50 intermediate outer end 52 and terminal end 54.

Connector portion 22 comprises a round connector tube 60 having an axis 72 passing longitudinally therethrough, an upper connector end 62 and a lower telescopic end 64. Connector portion 22 further comprises a connector plate 66, a pin 68 fixed to the plate end having a longitudinal axis 74, and a pin cap or head 70. Connector plate 66 is fixedly secured within connector tube 60 adjacent connector end 62, with connector plate 66 being non-orthogonal to axis 72. Pin 68 orthogonally affixes to connector plate 66 and extends upwardly from connector end 62 of connector tube 60. Consequently, axes 72 and 74 are angularly related.

Upper end 30 of the vertical rail 32 connects with outer end 52 of the transverse rail 50. Pin 68 of connector portion 22 extends through aperture 56 of the terminal end 54 of transverse rail 50. Pin cap 70 is simply a peened over end of pin 68 such that the terminal end 54 of transverse rail 50 is loosely captured between pin cap 70 and the connector end 62 of connector tube 60, allowing pin 68 and connector tube 60 to rotate about terminal end 54. Because axis 72 of connector tube 60 and axis 74 of pin 68 are angularly related, the connector tube will sweep a conical path when the tube is rotated. This allows the ladder to be used on either side of the boat as hereinafter explained.

A typical rod holder assembly 80 with which my ladder is usable comprises an annular mounting collar 82, a rod holder 84 having a longitudinal axis 85, and fasteners 86. Rod holder 84 fixedly secures to mounting collar 82 at a non-orthogonal angle. Gunnels 18 and 20 have apertures 88 through which rod holders 84 extend downwardly with mounting collars 82 residing atop of gunnels 18 and 20 and surrounding apertures 88. Fasteners 86 fixedly secure mounting collars 82 to gunnels 18. The rod holder is rotatably positioned on the gunnel 20 such that the axis 85 extends downwardly and laterally inwardly and forwardly. Accordingly, fishing rods inserted in rod holder 84 will extend laterally outwardly and rearwardly.

The axial alignment of pin 68 and connector tube 60, relative to terminal end 54 of transverse portion 24, is such that axis 85 of rod holder 84 and axis 72 of connector tube 60 are coaxially alignable, allowing for telescopic engagement of connector tube 60 within rod holder 84 on either port side 14 or starboard 16 of boat 12, while simultaneously providing for abutment of pad 58 and feet 47 against, respectively, either gunnel 18 or 20 and side 14 or 16 and with the ladder disposed generally vertical. These telescopic and abutting mountings provide stable securement of ladder 10 to boat 12.

In operation, ladder 10 is raised above gunnel 18 and connector tube 60 is pivoted about pin 68 until it is coaxially aligned with rod holder 84 while the ladder 10 is otherwise generally vertical. Ladder 10 is then lowered, first with connector tube 60 being telescopically received within rod holder 84, followed by pad 58 abuttingly engaging the top surface of gunnel 18 and with feet 47 abuttingly engaging port side 14 of boat 12. In the event the side 14 is angled sufficiently inwardly from top to bottom, the connector portion 22 and descending portion 26 are sufficiently flexible such that feet 47 will engage side 14 when a person's weight is placed upon intermediate steps 34 or bottom step 36.

To remove the ladder 10, feet 47 and pad 58 are lifted slightly outwardly and upwardly, respectively, away from port side 14 and gunnel 18, and then terminal end 54 is lifted coaxially upwardly along axis 85 of rod holder 84 to remove the connector tube 60 from the rod holder 84.

Figure 4:
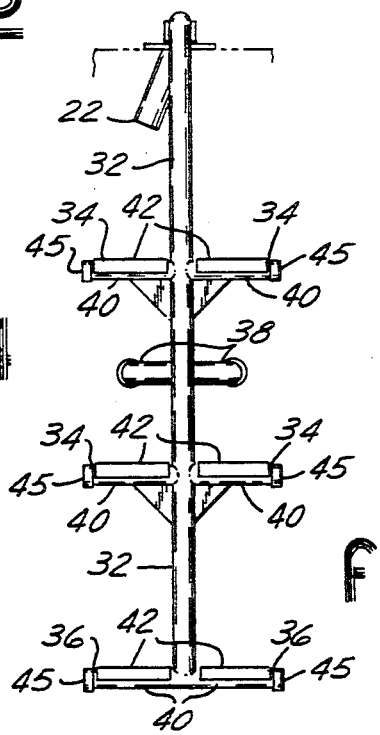
FIG. 4 shows a partial side view of the ladder mounting on the port side of the boat wherein the connector tube is pivoted left relative to the descending rail of the ladder.
Figure 5:
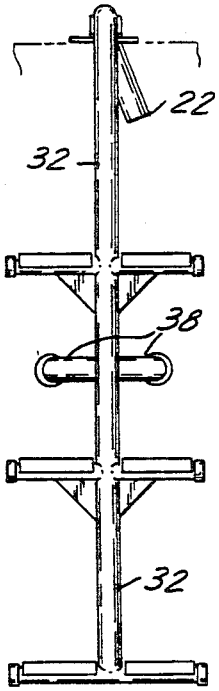
FIG. 5 shows a partial side view of a ladder mounting on the starboard side of the boat wherein the connector is pivoted right relative to the descending rail of the ladder.

FIGS. 4 and 5 show ladder 10 mounted to the port side 14 and the starboard side 16, respectively, of boat 12 as viewed from outside boat 12. The telescopic end 64 of connector tube 60 is left of vertical rail 32 in the port side view of FIG. 4 and to the right of vertical rail 32 in the starboard view of FIG. 5.

Accordingly, when ladder 10 is to be mounted to starboard side 18 instead of port side 18, the ladder 10 is transported from port side 14 to starboard side 18. Connector tube 60 is then pivoted about pin 68 until connector tube 60 and rod holder 84 are coaxially aligned wherein ladder 10 may be mounted as described above.

The foregoing description presents the preferred embodiment of this invention. Modifications and alterations may occur to those skilled in the art that will come within the scope and spirit of the invention.

What is claimed is:

1. A boarding ladder for mounting to a rod holder on the gunnel at either side of a boat, the rod holder having a rod receiving opening whose axis extends angularly downwardly and forwardly of the boat, said ladder comprising, in combination:

an ascending connector portion having a longitudinal axis and adapted to be telescoped into said opening in a rod holder on the gunnel at either side of a boat;

a descending portion to extend downwardly along the outside of a boat and having spaced apart steps and laterally extending stand offs for abutting against the side of the boat;

a transverse portion extending between the connector and descending portions and rigidly secured to the latter; and means securing together the connector and transverse portions for controlled rotation only about an axis oblique to the longitudinal axis of the connector portion, whereby when the connector portion is rotated into alignment with the rod holder opening and telescoped thereinto the descending portion may be disposed generally vertical and the stand offs may bear against the side of the boat to stabilize the ladder against free swinging movement.

2. The invention defined by claim 1 wherein said ascending connector portion has an upper end and said means comprises a headed pin secured to the upper end of the connector portion at an angle to the longitudinal axis of the connector portion, and said pin extends rotatably through the transverse portion with the head of the pin overlying the transverse portion on the opposite side from the connector portion to retain the transverse and connector portions together while permitting rotation therebetween about the axis of the pin.

3. The invention defined by claim 1 or claim 2 wherein said standoffs comprise a pair of feet spaced apart transversely of the descending portion.

4. The invention defined by claim 1 wherein said connector and descending and transverse portions are tubular members.

5. The invention defined by claim 4 wherein said descending and transverse portions comprise a continuous tubular member.

6. The invention defined by claim 2 wherein said transverse and connector portions are tubular members and said transverse portion is flattened where the headed pin extends therethrough to provide flat surfaces on opposite sides of the transverse portion; and the upper end of said connector portion having an end surface rotatably abutting one of said flat surfaces of the transverse portion, and the head of said pin abutting the flat surface of the opposite side of the transverse portion whereby the transverse portion is trapped between the head of said pin and the upper end of the connector portion for controlled rotation of the connector and transverse portions about the axis of the pin.

* * * * *